US011754269B2

(12) United States Patent
Wigginton et al.

(10) Patent No.: US 11,754,269 B2
(45) Date of Patent: Sep. 12, 2023

(54) LUMINAIRE DRIVER AND METHOD OF INSTALLATION

(71) Applicant: SIGNIFY HOLDING B.V., Eindhoven (NL)

(72) Inventors: Jacob Wigginton, Tupelo, MS (US); John Buse, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/608,440

(22) PCT Filed: May 7, 2020

(86) PCT No.: PCT/EP2020/062676

§ 371 (c)(1),
(2) Date: Nov. 2, 2021

(87) PCT Pub. No.: WO2020/225351

PCT Pub. Date: Nov. 12, 2020

(65) Prior Publication Data

US 2022/0196232 A1 Jun. 23, 2022

Related U.S. Application Data

(60) Provisional application No. 62/845,398, filed on May 9, 2019.

(30) Foreign Application Priority Data

May 24, 2019 (EP) ..... 19176353

(51) Int. Cl.
*F21V 23/00* (2015.01)
*F21V 29/508* (2015.01)
(Continued)

(52) U.S. Cl.
CPC ..... *F21V 23/008* (2013.01); *F21V 17/00* (2013.01); *F21V 29/508* (2015.01); *F21Y 2115/10* (2016.08); *H05B 45/30* (2020.01)

(58) Field of Classification Search
CPC ..... F21V 15/01; F21V 23/003; F21V 23/023; F21V 23/026
See application file for complete search history.

(56) References Cited

U.S. PATENT DOCUMENTS

2006/0061296 A1 3/2006 Fiene
2010/0200263 A1 8/2010 Tseng
(Continued)

FOREIGN PATENT DOCUMENTS

CN 107355697 A 11/2017
WO 2017160738 A1 9/2017

*Primary Examiner* — William J Carter

(57) ABSTRACT

Drivers (10) for a luminaire (12) are disclosed. The driver (10) includes a housing (13) designed to be capable of being inserted at least partially through an opening (18) formed by removing a knockout tab (18*a*) in a junction box (17) and into a plenum space that is not part of the splice compartment of the junction box. A plurality of components (11) for driving the luminaire (12) are locatable within the housing (13). An electrical connection (14) is provided to electrically coupling the plurality of components (11) to the luminaire (12). A method of installation for the drivers (10) is also disclosed.

17 Claims, 2 Drawing Sheets

(51) Int. Cl.

| | |
|---|---|
| ***F21V 17/00*** | (2006.01) |
| ***F21Y 115/10*** | (2016.01) |
| *H05B 45/30* | (2020.01) |

(56) References Cited

U.S. PATENT DOCUMENTS

| | | | | |
|---|---|---|---|---|
| 2012/0287616 | A1* | 11/2012 | Wilcox ..... | F21V 23/026 362/198 |
| 2013/0250579 | A1 | 9/2013 | Athalye | |
| 2016/0320007 | A1 | 11/2016 | Araki | |
| 2019/0064429 | A1 | 2/2019 | Boulanger et al. | |
| 2019/0086056 | A1 | 3/2019 | Nguyen et al. | |

* cited by examiner

LUMINAIRE DRIVER AND METHOD OF INSTALLATION

CROSS-REFERENCE TO PRIOR APPLICATIONS

This application is the U.S. National Phase application under 35 U.S.C. § 371 of International Application No. PCT/EP2020/062676, filed on May 7, 2020, which claims the benefit of U.S. Patent Application No. 62/845,398, filed on May 9, 2019, which claims the benefit of European Patent Application No. 19176353.1, filed on May 24, 2019. These applications are hereby incorporated by reference herein.

FIELD OF THE INVENTION

The invention relates to luminaire drivers and methods of installing the luminaire drivers, more particularly, to an LED driver having a housing capable of being inserted into and through an opening in a standard wiring junction box that can be used for either retrofit or new installations.

BACKGROUND

Upgrading from a traditional lighting system to newer lighting systems provides for energy savings as well as possible maintenance savings. Such traditional lighting systems include incandescent tungsten filament lamps which were the first source of light that was created. HID or metal halide lamps and fluorescent lamps that were later used to provide increased lamp life and brighter outputs over the incandescent lamps. More recently, advances in LED brightness and efficacy have allowed LED lamps and LED modules to be developed that could offer even longer lamp life and brighter outputs when properly configured, to compete with incandescent, HID or fluorescent lamps. An LED driver is used to provide the correct power to the LEDs either through PWM, constant voltage, or constant current. The LED lamps and LED modules can be hard-wired directly to the LED driver in an internal or external configuration, or can be eliminated with the use of dimmable AC LEDs and special IC chips.

LED technology reduces electrical demand and energy consumption compared to conventional fluorescent lighting systems, and also offers controllability, light uniformity, and less maintenance. In this regard, LED luminaires are an efficient alternative source of light. By utilizing a plurality of LEDs in a defined arrangement, the LEDs may be utilized to provide an alternative to current luminaires discussed above. For the LED luminaires (e.g., bulbs, tubes, fixtures) to be widely adapted they need to be able to replace current luminaires in existing lighting configurations.

In some applications, it is desirable to have an LED bulb or LED module that can be installed into existing incandescent, compact fluorescent or HID fixtures to ultimately create a longer lasting and energy efficient LED light fixture. For example, fluorescent lighting luminaires are widely used in commercial establishments (e.g., office buildings, retail stores, apartment complexes, hotels). Such fluorescent lighting luminaires generally include a housing that is typically located on the ceiling. The housing includes a plurality of fluorescent tubes. The tubes require a high initial voltage to begin operation (lighting) and then require a constant current to operate so that a ballast is used to receive the line power (e.g., 120V, 240V) to provide the operating power requirements for the tubes. In some applications, a conventional retrofit LED tube may be used that has the same, substantially the same, or similar footprint and form factor to be able to replace the florescent tube in the housing. However, such conventional retrofit LED tubes cannot be used if the entire fluorescent lighting luminaire (i.e., removing the housing) is to be replaced with a new luminaire, e.g., a smaller, more modern fixture.

In this regard, conventional LED luminaires exist that are designed so that an LED driver module is installed into a wiring box (also called junction box). The wiring boxes are concealed behind a wall or ceiling. The wiring box acts as the required housing enclosure for the LED driver module. The LED driver module is placed within the wiring box using some of the space normally needed for wiring connections.

However, there are two main problems or shortcoming with such conventional LED luminaires and the conventional LED driver modules. First when higher wattage luminaires are needed, the LED drivers become too large to fit into the wiring box. Second, larger LED driver modules generate more heat which may not be able to not properly dissipate within the wiring box. This may lead to failure of the LED driver module and possibly a fire hazard.

Aspects and embodiments of the present invention address one and/or both of these shortcomings by providing an LED driver for the use with higher wattage luminaires when using conventional wiring boxes for fixture mounting. This allows for (1) more space for "building" wiring connections when using conventional wiring boxes for the fixture mounting and (2) better dissipation of heat generated by the higher wattage LED drivers because the LED driver is located in a larger air space provided by a wall or ceiling plenum space rather than confined within the conventional wiring box.

SUMMARY OF THE INVENTION

One aspect of the present invention is related to an improved method using an LED driver that is capable of being inserted into and through a knockout hole of a wiring junction box. The LED driver can be locked into position, using tabs, in its final position, inside a plenum space of the building. The wiring for the LED driver is accessible in the junction box. In this regard, the LED driver can be inserted from a room side of a building for retrofit applications, through the junction box via the knockouts into plenum space of the building. This allows for more space in the wiring box for wiring and allows for larger LED drivers for luminaires with higher power.

Another aspect of the present invention allows for better dissipation of heat generated by the higher wattage LED drivers.

One embodiment of the present invention is directed to a driver for a luminaire including a housing capable of being inserted at least partially through an opening in a junction box and into a plenum space that is not part of a splice compartment of the junction box. A plurality of components are located in the housing for driving the luminaire and electrical connection for electrically coupling the plurality of components to the luminaire. In one embodiment, the driver is an LED driver and the luminaire is an LED luminaire.

Another embodiment of the present invention is directed to a method for installing an LED driver for an LED luminaire. The method includes the steps of either removing a knockout tab to form at least one opening in the from a junction box or using at least one existing opening and inserting the LED driver at least partially through the opening and into a plenum space that is not part of a splice compartment of the junction box. The method further includes the steps of securing the LED driver to the junction box and electrically connecting the LED driver to the LED luminaire (12). The step of securing the LED driver may be done using a fastener.

BRIEF DESCRIPTION OF THE DRAWINGS

Further details, aspects, and embodiments of the invention will be described, by way of example only, with reference to the drawings. Elements in the figures are illustrated for simplicity and clarity and have not necessarily been drawn to scale. In the Figures, elements which correspond to elements already described may have the same reference numerals. In the drawings.

DETAILED DESCRIPTION OF PREFERRED EMBODIMENTS

Figure 1:
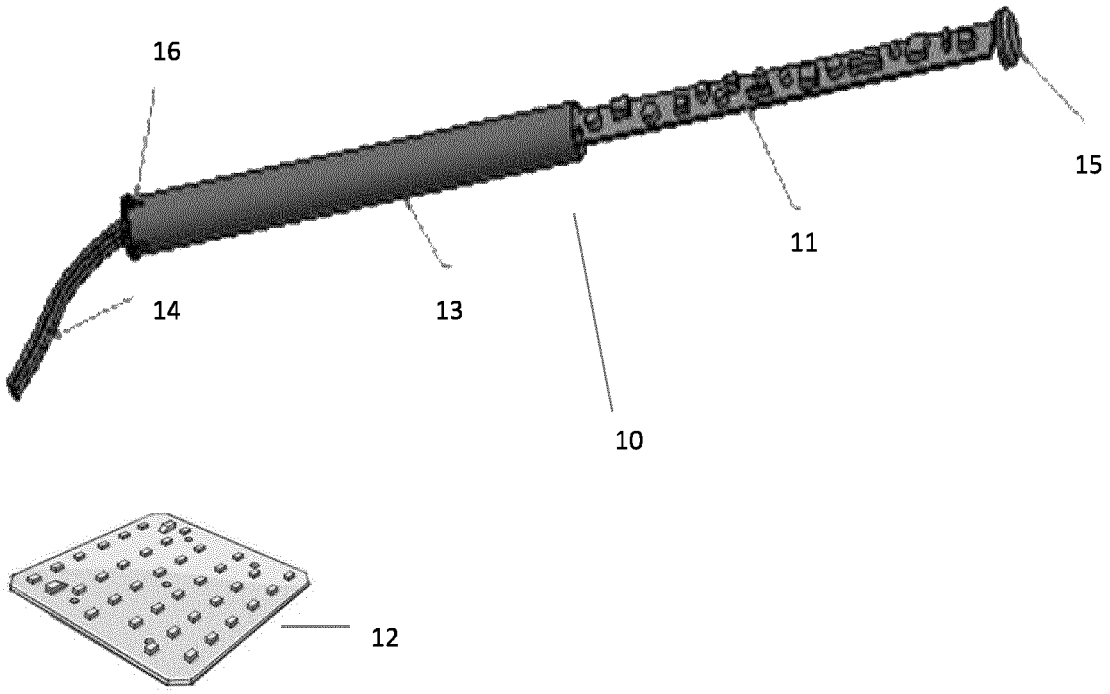
FIG. 1 shows an LED driver in accordance with an embodiment of the present invention.

While this invention is susceptible of embodiment in many different forms, there are shown in the drawings and will herein be described in detail one or more specific embodiments, with the understanding that the present disclosure is to be considered as exemplary of the principles of the invention and not intended to limit the invention to the specific embodiments shown and described.

In the following, for the sake of understanding, elements of embodiments are described in operation. However, it will be apparent that the respective elements are arranged to perform the functions being described as performed by them.

Further, the invention is not limited to the embodiments, and the invention lies in each and every novel feature or combination of features described herein or recited in mutually different dependent claims.

FIG. 1 shows an LED driver 10 in accordance with one embodiment of the present invention. The LED driver 10 includes a plurality of components 11 for providing operating voltage and current to an LED luminaire 12. The components 11 may be arranged on a printed circuit (PC) board that is removable from a housing 13. For example, the components 11 may be able to slide out the housing 13 for repair or to be changed. The components 11 may include a connector (not shown) to electrically connect to the housing 13 and/or leads 14. The leads 14 (directly or indirectly) electrically connect the LED driver 10 to the LED luminaire 12 and/or a power source (not shown). The leads 14 may be a wire, connector or other conventional coupling means.

The LED driver 10 may also include a cap 15. The cap 15 may be used to provide cover from the environment for the components 11 and/or to help lock the components 11 inside the housing 13. One of ordinary skill in the art will appreciate that the cap 15 is not necessary in all embodiments. The function of the cap 15 may also be performed/integrated by the housing 13 and/or PC board of the components 11.

Figure 2:
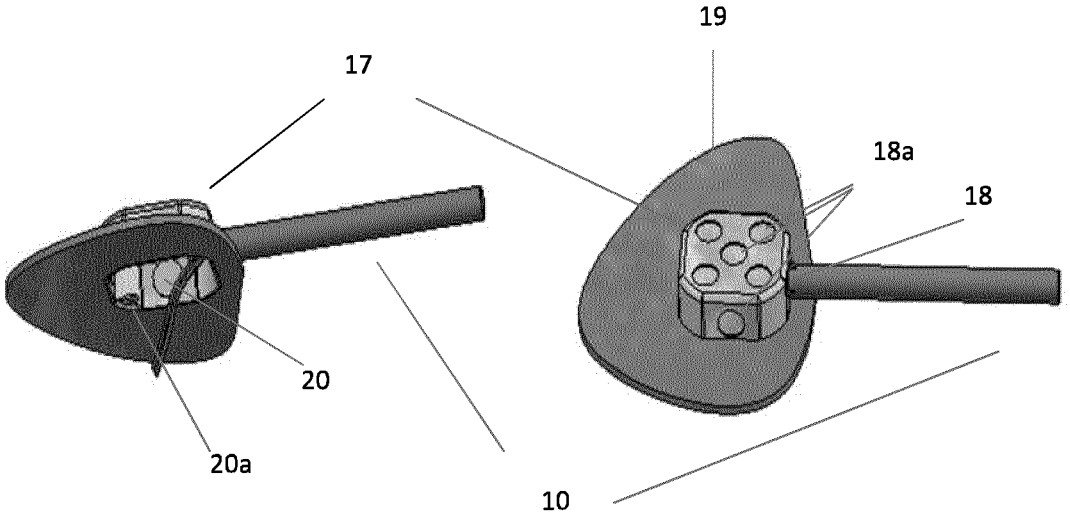
FIG. 2 shows the LED driver of FIG. 1 installed into a junction box.

The LED driver 10 further may include a faster 16 to position and/or lock the LED driver 10 with in a junction box 17 (shown in FIG. 2). The fastener 16 may be a hardware device that mechanically joins or affixes the LED driver 10 within an opening 18 (the junction box 17 includes a main opening to allow access to a splice compartment 20 and may include a plurality of knockout tabs 18*a* as shown in FIG. 2) of the junction box 17. In general, the fastener 16 is used to create non-permanent joint that can be removed or dismantled without damaging the LED driver 10. In this regard, the fastener 16 may be a tab, clamp, clip or screw thread connector. The joint may also be permanent if desired, e.g., via welding. The fastener 16 may be made of metal, plastic, composite, alloy or other material generally used for fastening. Other alternative methods of joining the LED driver 10 to the opening 18 may include crimping, soldering, brazing, taping, gluing, cement, or the use of other adhesives. Force may also be used, such as with magnets, vacuum (like suction cups), or even friction (like sticky pads).

The plurality of components 11 drive the LED luminaire 12. The components 11 may include supply and control circuits, an isolation circuit (e.g., opto-isolator, transformer), a rectifier/filter, and current (and possibly voltage) monitoring circuitry. The LED driver 10 may slice or switch the received voltage into small slices so that the signal can be transmitted efficiently across the isolation circuit. The alternating current (AC) of the slices induces electricity on the secondary windings of the isolation circuit. The AC frequency of the slices determines the amount of current that will flow through the LED luminaires (e.g., fixtures, bulbs, tubes, arrays) being powered thereby. The LED driver 10 may be programmed based on various parameters including parameters related to the power supply it is utilized in and LED luminaires 12 it will be powering. The LED driver 10 may also be used for power factor correction to ensure that its power supply meets energy efficiency standards.

The isolation circuit may perform a step-down function and may convert the energy to the energy necessary to operate the LED luminaires 12 (e.g., 120V to 30V). Alternatively, other circuitry (not illustrated) may be used to convert (e.g., further step-down) the energy to the level required by the LED luminaires 12. The isolation circuit isolates the power source from the LED drives so as to prevent inadvertent contact with line power. The rectifier/filter converts AC voltage to a DC voltage and filters out any noise.

The current monitoring circuitry may monitor current through the LED luminaires 12 indirectly (by measuring the frequency of the AC signal) on the primary side of the isolation circuit. The current monitoring circuitry may provide feedback (e.g., reference signal associated with the measured current) to adjusts the frequency of the AC voltage (corresponding to current) to increase or decrease the current accordingly. Voltage monitoring circuitry may monitor voltage across the LED luminaires 12 by measuring the voltage drop across the primary side of the isolation circuit to ensure the LED luminaires 12 voltage doesn't reach dangerous levels. The monitored LED luminaires 12 voltage may be may adjusted taking this measurement into account as well.

It will be understood by one of ordinary skill in the art that other known circuitry, elements and modules may be used to provide the necessary voltage and current to drive the LED luminaires 12. The present invention is also not limited to LED drivers (10) but may be include other types of drives for luminaires.

It should also be understood that the term LED does not limit the physical and/or electrical package type of an LED. For example, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "lighting fixture" or "luminaire" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The housing 13 is designed to be capable for being inserted through one or more of openings 18. As shown in the embodiment of FIG. 1, the house 13 may be tubular, e.g., a cylindrical tube. However, the housing 13 is not limited to this shape and may be any shape that is capable of being inserted full or partially through one or more of the openings 18. For example, the housing 13 maybe a rectangular shape, a polyhedral shape, an octagon tube, a 3D curved shape, a 3D shape with an angle in the middle or elsewhere (e.g., 30, 45 or 90 degrees), a U-shaped container, a non-circular 3D shape or other container capable of housing the components 11 and fitting through the opening 18. The housing 13 may also include vents to facilitate heat dissipation and may be made of metal, plastic, composite, alloy or other material that may facilitate heat dissipation.

Some of the objectives for retrofitting older luminaires (e.g., incandescent or fluorescent) with LED luminaires 12 is to conserve power (and thus save money) and to make the transition as easy and inexpensive as possible. Aside from material costs for the LED luminaires 12, the end user must take installation labor into consideration. Making the installation of LED luminaries 12 quick, easy and simple is one important consideration in the design thereof. One of the ways some of the embodiments of the present invention simply installation is by the use of the existing openings 18 of the junction boxes 17. The junction box 17 may have been already used for a previous non-LED luminaire. For example, as shown in FIG. 2, the junction box 17 is preexisting and mounted behind a wall or ceiling 19. The installer does not need to remove or add any additional junction box 17 or housings when installing the LED driver 10 for the new LED luminaire 12 according to one or more embodiments of the present invention. The LED driver 10 fits in the space behind the wall or ceiling 19 (e.g., between the studs or support beams of the walls or ceiling 19).

For purposes of the present invention, the junction box 17 includes a housing that provides protection and a safety barrier for electrical connections. The housing may be on any appropriate configuration such but not limited to a box, rectangle, hexagon or other 3D shape. The housing may be made, for example, from metal, plastic, composite or other material. The housing may form part a building's electrical wiring system.

The junction box 17 provides a secure environment for electrical wires, generally known (in the US for example) as hot (black), white (neutral) and grounding (green or copper). Other colors of wires, which are used for secondary functions and for lighting control. The junction box 17 serves as the communal meeting spot for electrical wires, where they connect before moving on. In this regard, the junction box 17 will have a splice compartment 20 (shown in FIG. 2) for the electrical wires into which power, lighting control wires and/or data wires are placed. The interconnection or communal meeting of such power, lighting control wires and/or data wires may be made via a junction box opening **20*a*. The junction boxes 17** must be installed correctly and in compliance with the applicable building codes.

Electricians typically secure the junction box 17 to a strong structural location such as a stud or joist which is generally necessary if the junction box 17 will be used to support a light fixture. The junction boxes 17 may also be called a receptacle box or other names such as mounting box, fixture box, handy box, remodeling box, light switch box, receptacle box, outlet box, electrical box, and ceiling fan box.

In the US, the junction boxes 17 come a variety of sizes but two typical sizes are junction boxes 17 that measure 2 inches×3 inches and 2½ inches deep generally contain three wires and junction boxes 17 that measure 2 inches×3 inches and 3½ inches deep are made for five or more wires.

As shown in FIG. 2, the junction boxes 17 include the plurality of knockouts tabs **18*a*. The knockouts tabs 18*a* may be partially stamped, "quarter coin"-size (in the US, typically about ¾" in diameter) to form the openings 18 in the junction box 17 that service such things as outlets and switches. Once removed, the opening 18 allows electrical wires to be run in and out of the junction box 17. While ¾" is most common size for the openings 18 for residential and building lighting applications, the openings 18 come in variety of sizes including ½", ¾", 1", 1¼", 1½", and 2". It will be appreciated by one of ordinary skill in the art that other configurations of junction boxes 17 are possible, e.g., including the openings 18 with no knockout tabs 18*a***.

Figure 3:
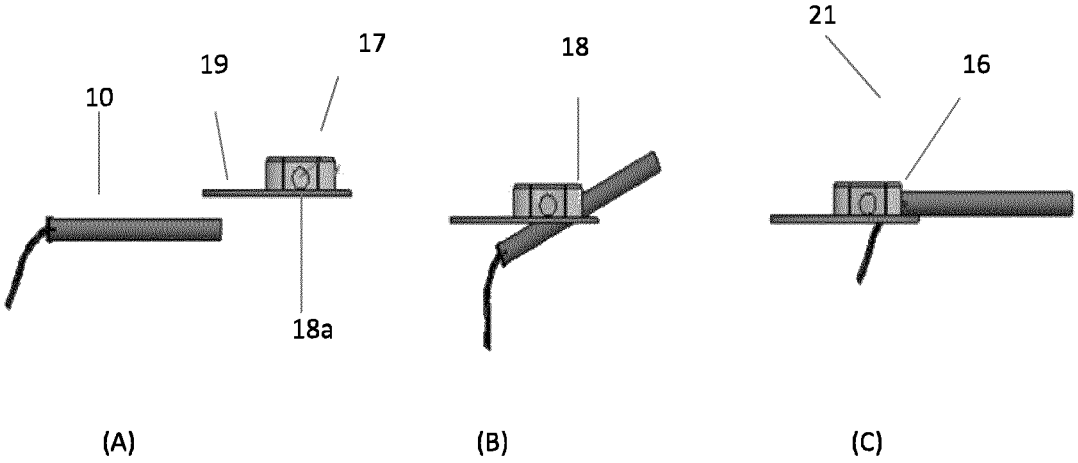
FIG. 3 shows a method of installing the embodiment of FIG. 1 into a junction box.

FIG. 3 shows a method of installing the LED driver 10 into the junction box 17 via the opening 18. In step A, the LED driver 10 is separate and not installed in the junction box 17. An installer must first determine the appropriate opening 18 for insertion or connection of the LED driver 10. The opening 18 may already be in place or one or more of the knockout tabs **18*a* may need to be removed. The installer must ensure that there is space, e.g., behind the wall 19, ceiling 19, etc., to fit the LED driver 10. In step B, the LED driver is inserted, pushed, moved, arranged, placed, in or partially in the opening 18. In step C (optional), the LED driver maybe secured in place with the fastener 16. As shown in steps A-C, the LED driver 10 is designed to be capable of being inserted from a room side of a building for retrofit or new applications through the junction box 17 via the opening 18 into plenum space 21 (i.e., behind the wall 19 or ceiling 19) of the building. The installer may make an electrically connection between the LED driver (10) and the LED luminaire (12) using the leads 14**.

This method allows for more space in the junction box 17 for wiring and allows for larger LED drivers 10 for LED luminaires 12 with higher power. This also allows for better dissipation of heat generated by the LED drivers 10 because the LED driver 10 is located in a larger air space provided by the plenum space 21 rather than confined within the junction box 17.

The foregoing detailed description has set forth a few of the many forms that the invention can take. The above examples are merely illustrative of several possible embodiments of various aspects of the present invention, wherein equivalent alterations and/or modifications will occur to others skilled in the art upon reading and understanding of the present invention and the annexed drawings. In particular, regard to the various functions performed by the above described components (devices, systems, and the like), the terms (including a reference to a "means") used to describe such components are intended to correspond, unless otherwise indicated to any component, such as hardware or combinations thereof, which performs the specified function of the described component (i.e., that is functionally equivalent), even though not structurally equivalent to the disclosed structure which performs the function in the illustrated implementations of the disclosure.

Although a particular feature of the present invention may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

In the claims references in parentheses refer to reference signs in drawings of exemplifying embodiments or to formulas of embodiments, thus increasing the intelligibility of the claim. These references shall not be construed as limiting the claim.

The invention claimed is:

1. A driver for a luminaire, the driver comprising:

a housing configured to be insertable into a first opening of a splice compartment of a junction box and, at least partially, out of a second opening of the junction box and into a plenum space that is not part of a splice compartment of the junction box, wherein the junction box is connected to a wall or ceiling and the splice compartment is between the plenum space and an area of space to be illuminated via the luminaire and wherein the first opening provides access to the space to be illuminated and the second openings provides access the plenum space;

a plurality of components within the housing for driving the luminaire; and an electrical connection for electrically coupling the plurality of components to the luminaire.

2. The driver according to claim 1, wherein the driver is an LED driver and the luminaire is an LED luminaire.

3. The driver according to claim 2, wherein the housing is substantially strait and tubular.

4. The driver according to claim 2, wherein the housing is U-shaped.

5. The driver according to claim 2, wherein the housing has a curve.

6. The driver according to claim 2, wherein the housing has a cross-sectional shape that is non-circular.

7. The driver according to claim 2, wherein the LED driver further includes a fastener to secure the housing to the junction box.

8. The driver according to claim 2, wherein the plurality of components are at least partially removeable from the housing.

9. The driver according to claim 2, wherein the housing is made from a material that facilitates heat dissipation.

10. The driver according to claim 2, wherein the housing extends substantially out of the second opening of the junction box.

11. The driver according to claim 2, wherein the plurality of components are arranged on a printed circuit board that is capable of being slide out of the housing.

12. The driver according to claim 2, wherein at least one of the first opening or the second openings is substantially circular in shape, having a diameter of less than 2 inches.

13. A method for installing an LED driver for an LED luminaire, the method comprising the steps of:

inserting the LED driver through a first opening of a splice compartment of a junction box and at least partially out of a second opening of the splice compartment and into a plenum space that is not part of the splice compartment of the junction box, wherein the junction box is connected to a wall or ceiling and the splice compartment is between the plenum space and an area of space to be illuminated via the luminaire and wherein the first opening provides access to the space to be illuminated and the second openings provides access the plenum space;

securing the LED driver to the junction box; and electrically connecting the LED driver to the LED luminaire.

14. The method according to claim 13, wherein the step of securing the LED driver includes using a fastener.

15. The method according to claim 13, wherein said junction box has been previously fixedly mounted in the plenum space before the step of inserting the LED driver.

16. The method according to claim 13, wherein at least one of the first opening or the second openings is substantially circular in shape, having a diameter of less than 2 inches.

17. The method according to claim 13, wherein the inserted LED driver extends substantially out of the second opening of the splice compartment and into the plenum space.

* * * * *